United States Patent [19]

Spliethoff

[11] Patent Number: 4,549,401

[45] Date of Patent: Oct. 29, 1985

[54] METHOD AND APPARATUS FOR REDUCING THE INITIAL START-UP AND SUBSEQUENT STABILIZATION PERIOD LOSSES, FOR INCREASING THE USABLE POWER AND FOR IMPROVING THE CONTROLLABILITY OF A THERMAL POWER PLANT

[75] Inventor: Heinz Spliethoff, Friedrichsthal, Fed. Rep. of Germany

[73] Assignee: Saarbergwerke Aktiengesellschaft, Saarbrücken, Fed. Rep. of Germany

[21] Appl. No.: 494,765

[22] PCT Filed: Dec. 23, 1981

[86] PCT No.: PCT/EP81/00204

§ 371 Date: May 13, 1983

§ 102(e) Date: May 13, 1983

[87] PCT Pub. No.: WO83/01090

PCT Pub. Date: Mar. 31, 1983

[30] Foreign Application Priority Data

Sep. 19, 1981 [DE] Fed. Rep. of Germany ..... 3137371

[51] Int. Cl.[4] ..... F01K 3/00

[52] U.S. Cl. ..... 60/652; 60/659

[58] Field of Search ..... 60/646, 652, 659, 678, 60/688, 691, 692, 693

[56] References Cited

U.S. PATENT DOCUMENTS

| | | | |
|---|---|---|---|
| 1,770,256 | 7/1930 | Smekal . | |
| 4,129,004 | 12/1978 | Thelen et al. | 60/652 |
| 4,130,992 | 12/1978 | Bitterlich et al. | 60/659 X |
| 4,291,537 | 9/1981 | Oplatka | 60/659 |

FOREIGN PATENT DOCUMENTS

| | | | |
|---|---|---|---|
| 628717 | 10/1926 | Fed. Rep. of Germany | 60/659 |
| 1128437 | 4/1962 | Fed. Rep. of Germany | 60/652 |
| 204975 | 9/1939 | Switzerland . | |
| 446061 | 5/1936 | United Kingdom . | |
| 709888 | 6/1954 | United Kingdom . | |
| 887274 | 1/1962 | United Kingdom . | |

OTHER PUBLICATIONS

Brown Boveri Mitteilungen, Aug., 1980, p. 459.

*Primary Examiner*—Stephen F. Husar

*Attorney, Agent, or Firm*—Nils H. Ljungman

[57] ABSTRACT

In a method for reducing the start-up and stabilization period losses, for increasing the usable power and to improve the controllability of a thermal power plant, there are integrated into the power plant's steam cycle pressurized heat storage reservoirs which are charged by feeding them with excess heat produced in the said power plant as, for example, during the start-up and load stabilizing periods or during periods of reduced electrical power production and, when there is an increased demand for heat, the said heat storage reservoirs are discharged by the release of stored heat into the water-steam cycle. Control deviations in the electrical power while the power plant is in full operation are counterbalanced by changes in the charging and discharging streams of the pressurized heat storage reservoirs. In the apparatus for carrying out this method, pressurized heat storage reservoirs are connected, on the water-side, to the condensate system and, on the steam side, to the medium pressure of intermediate superheater network of the steam cycle or also to the power plant's medium pressure or low pressure turbine extraction points.

3 Claims, 1 Drawing Figure

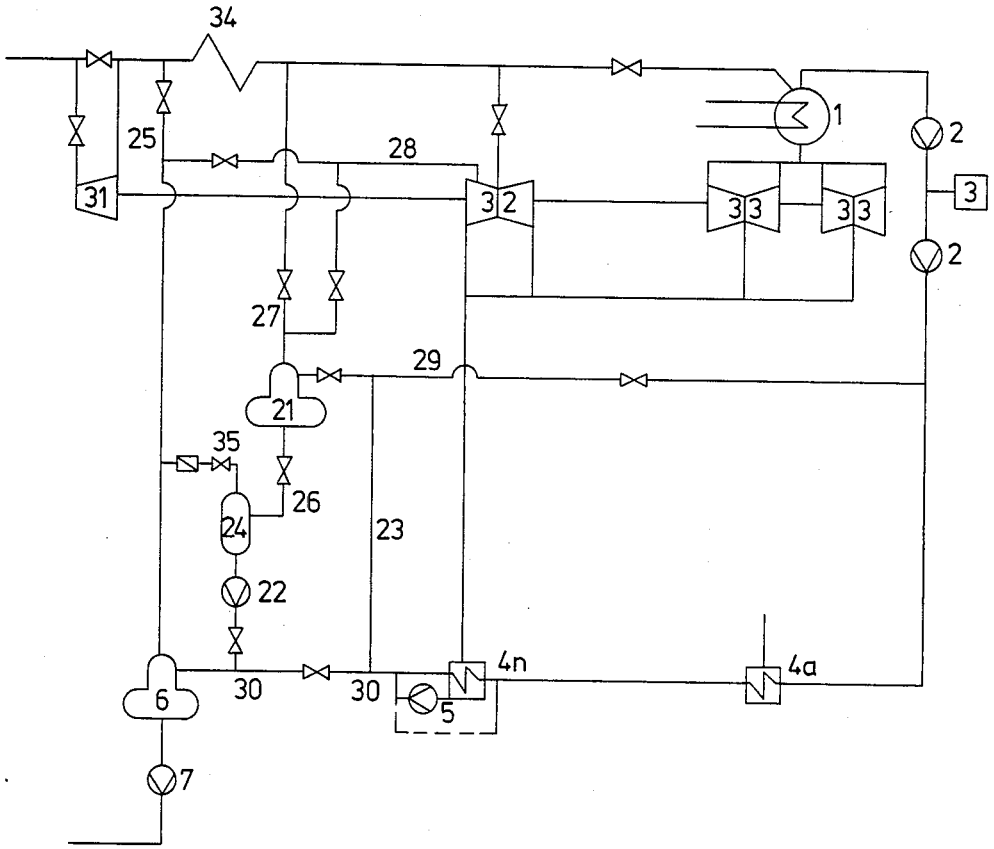
34
25
28
31
32
33
33
1
2
3
2
27
29
21
35
26
24
23
22
30
30
4n
4a
6
5
7

METHOD AND APPARATUS FOR REDUCING THE INITIAL START-UP AND SUBSEQUENT STABILIZATION PERIOD LOSSES, FOR INCREASING THE USABLE POWER AND FOR IMPROVING THE CONTROLLABILITY OF A THERMAL POWER PLANT

The invention relates to a method and apparatus for reducing the losses which occur initially on start-up and which subsequently occur during the following stabilization period prior to normal running conditions; the invention also relates to a method and apparatus for increasing the usable power and for improving the controllability of a thermal power plant.

During the initial start-up period and the immediately following stabilization period in conventionally operated thermal power plants, large quantities of steam must bypass the turbine complex through the condenser. During this process, enormous quantities of heat remain unused and are given off via the condenser cooling water and the cooling tower into the atmosphere.

In particular, with large power plant systems, the initial start-up period and the subsequent stabilizing period can take up to an hour or more, depending on the condition of the installation. In addition to this, many conventional power plant systems must be shut down regularly at weekends and at night. The quantities of heat which are produced during these start-up and stabilizing periods, and which constitute a considerable fraction of the total amount of converted thermal energy, are released unutilized.

It has also been found, unfortunately, that a power plant system cannot be controllably operated when working at its upper load limit, especially at the limit of its rated pyrometric power, since, in order to attain power-controlled operation, it is necessary to retain a certain controllable load reserve in order to compensate for fluctuations in the demand.

Compensation of the control deviations in the electrical power of a power plant system from the demand power can only be effected via the time-behavior of the steam production and the storage capacity of the steam generator which decisively determines the controllability of the power plant system.

The object of the invention is to improve the economy of operation of a power plant by reducing the initial start-up and following stabilizing period losses and thereby increasing the plant's utilizable power. A further objective of the invention is to improve the controllability of a power plant.

In accordance with the invention, this object is accomplished by arranging for one or more pressurized heat storage reservoirs to be integrated into the power plant's water-steam cycle, the said heat storage reservoirs being charged by supplying them with excess heat produced in the power plant and, in the event of an increased demand for steam, discharging the said heat storage reservoirs by releasing stored heat back again into the water-steam cycle.

The pressurized heat storage reservoirs are charged during the start-up and stabilizing processes with start-up steam or stabilization period steam.

The pressurized heat storage reservoirs return their charged energy to the power plant's water-steam cycle during periods of high load or periods when there is an increased demand for power to produce electrical energy.

Thus, it is possible, with the method according to the invention, to store an appreciable fraction of the energy, hitherto given-off, unused,.into the atmosphere during the start-up and following stabilizing phases of a power plant system, and to use this energy during periods of increased power demand.

In order to effect a further increase in the upper load limit, it is additionally advantageous, during low or partial load periods, to charge the pressurized heat storage reservoirs with hot condensate via medium pressure/low pressure preheaters using steam bled from the medium pressure steam system and/or suitable extractions from the medium pressure and/or low pressure turbines.

In an additional embodiment of the method according to the invention, control deviations in the electric power from the demand power of a power plant system are at least partially compensated by changes made in the pressurized heat storage reservoirs' charging or discharging flow.

By this means, it is additionally possible to reduce a power plant system's available demand load reserve, which must necessarily be retained, by the normal output of the pressurized heat storage reservoirs, and by correspondingly increasing the rated load of the power plant system.

In the accompanying drawing there is illustrated a schematic representation of a steam power plant circuit embodying a present preferred embodiment of the invention.

Further detail concerning the invention may be derived from the constructional example illustrated schematically in the appended figure. In the power plant system shown by way of example in the figure, steam flows in succession through a high pressure turbine 31, an intermediate super-heater 34, a medium pressure turbine 32 and also through a double channel low pressure turbine 33. The condensate formed in a condenser 1 is fed into a feed-water tank 6 via the condensate pumps 2 and the low pressure-medium pressure preheaters **4*a* to 4*n*, and passes again from the tank 6 into the steam generator via a feed-water pump 7. A sink-tank for storing condensate is denoted by 3**.

On the water side, a pressurized heat storage reservoir 21 is connected in shunt with the condensate system via pipe-lines 23 and 26 and a pump 22. In the example illustrated, a pressurized pipe-line following the discharge pump 22 discharges into a condensate pipe-line 30 at a point between the last medium pressure-low pressure preheater **4*n* and the feed-water tank 6. The pressurized pipe-line can, however, also feed directly into the feed-water tank 6**.

On the steam side, the pressurized heat storage reservoir 21 is connected via a pipe-line 27 to the medium pressure or intermediate super-heater network of the power plant unit and/or to other commercially suitable steam networks and steam systems having a steam pressure higher than that present in the pressurized heat storage reservoir 21 as, for example, to an extraction pipe 28 which also supplies the feed-water tank 6 with steam. In order to charge the pressurized heat storage reservoir 21 during a start-up or a stabilization period, steam is fed from the medium pressure intermediate heater network via the pipe-line 27, if need be, via the intermediary of a pressure reducing regulator, into the pressurized heat storage reservoir 21 which is prefilled with cold condensate, whereby the condensate contained therein is heated.

In another start-up and stabilization period control arrangement, the steam used during the start-up or stabilization period heats a stream of condensate through pipeline 29, either directly or via a steam pressure reducing regulator and in a controlled or uncontrolled manner, to produce a boiling water or hot water stream with which the pressurized heat storage reservoir 21 is charged.

During power operation, the pressurized heat storage reservoir 21 is charged in low or partial load periods with hot condensate via the low pressure-medium pressure preheaters 4*a* to 4*n*, whereby the hot stream of condensate from the same extraction pipe-line 28, which also supplies the feed-water tank 6 with steam, is further heated in a preheating mixing and degassing stage (not shown in the figure) located directly ahead of the pressurized heat storage reservoir 21.

Along with the discharge, hot condensate from the pressurized heat storage reservoir 21 is admixed, via pipe-line 26, the depressurizer 24 and the discharging pump 22, with the condensate flowing in the pipe-line 30 to the feed-water tank 6.

If, from time to time, the pressurized heat storage reservoir 21 is operated at a pressure which is elevated with respect to the feed-water tank 6, the hot storage discharge stream from the reservoir can be depressurized in the depressurizer 24 to the pressure present in the feed-water tank 6, and fed into the condensate pipeline 30.

The stream of depressurized steam is fed via a pipeline 35 directly into the feed-water tank 6 or alternatively into a steam line 25 which leads to the feed-water tank 6.

By this means, the discharge stream and the contents of the feed-water tank attain the same thermodynamic state.

In a simplified circuit, the depressurizer 24 and the pipe-line 35 can be dispensed with and the discharge stream, with the enthalpy of the contents of the pressurized heat storage reservoir, can be fed directly into the condensate pipe-line 30. Of course, associated with this arrangement is a limitation to the discharge flow in the lower load periods when the pressure in the pressurized heat storage reservoir 21 is greater than the pressure in the feed-water tank 6. Consequently, in this simplified thermal cycle, it is necessary to provide a safety-control cycle which prevents evaporation from occurring in the condensate pipe-line 30 and at the inlet to the feed-water tank.

By using the charging and discharging streams of the pressurized heat storage reservoir 21 as regulating quantities in load regulation, it is possible, when the plant is in operation, to control, simply and rapidly, any departures of the electrical power from its demand value within the desired power control range.

What we claim is:

1. An apparatus for use in a thermal power plant water vapor circuit associated with a steam generator and having a steam side and a water side, said apparatus being operable to reduce start-up and shutdown losses, to increase usable power from the plant and to improve control of the plant, said apparatus comprising pressure heat accumulator means connected to the steam side whereby start-up steam, shutdown steam and excess steam may be introduced to the pressure accumulator means, said apparatus being characterized by connection of the pressure heat accumulator means to the water side at a point after the water passes through feedwater preheater means, and by connection from the pressure heat accumulator means to a feedwater tank; with depressurizer means in circuit between the pressure heat accumulator means and the steam connection to the feedwater tank.

2. An apparatus according to claim 1, characterized in that, on the water side, the pressurized heat accumulator means are connected in bypass, via the pipe-lines (23), (26), and the pump (22) with a condensate pipe-line (30) following a last medium pressure-low pressure preheater (4*n*) and ahead of a feed-water tank (6).

3. An apparatus according to claim 1, characterized in that, on the water-side, the pressurized heat accumulator means (21) are bypass connected, via the pipe-lines (23) (26) and the pump (22), with the feed-water tank (6).

* * * * *